US005544881A

United States Patent [19]

Rua, Jr. et al.

[11] Patent Number: 5,544,881

[45] Date of Patent: Aug. 13, 1996

[54] ERASABLE SCRATCH-OFF LOTTERY TICKET

[75] Inventors: Louis Rua, Jr., Plainsboro; Stephen E. Martin, Jamesburg, both of N.J.

[73] Assignee: Webcraft Technologies, Inc., North Brunswick, N.J.

[21] Appl. No.: 183,389

[22] Filed: Jan. 19, 1994

[51] Int. Cl.[6] ..... A63F 3/06

[52] U.S. Cl. ..... 273/139

[58] Field of Search ..... 273/139, 240, 273/269, DIG. 14; 283/901, 903

[56] References Cited

U.S. PATENT DOCUMENTS

| | | | |
|---|---|---|---|
| Re. 34,673 | 6/1994 | Desbiens . | |
| 2,618,866 | 11/1952 | Adams . | |
| 3,602,513 | 8/1971 | Breen | 273/240 |
| 3,603,592 | 9/1971 | Bury | 273/240 |
| 3,618,231 | 11/1971 | Nason | 273/240 X |
| 4,037,007 | 7/1977 | Wood . | |
| 4,084,332 | 4/1978 | Waloszyk et al. . | |
| 4,095,824 | 6/1978 | Bachman . | |
| 4,120,445 | 10/1978 | Carrier et al. . | |
| 4,212,468 | 7/1980 | Knott | 273/240 |
| 4,273,362 | 6/1981 | Carrier et al. . | |
| 4,354,845 | 10/1982 | Poteet et al. | 434/410 |
| 4,425,386 | 1/1984 | Chang . | |
| 4,486,033 | 12/1984 | Parotta . | |
| 4,488,646 | 12/1984 | McCorkle . | |
| 4,634,149 | 1/1987 | Donovan . | |
| 4,677,553 | 6/1987 | Roberts et al. . | |
| 4,725,079 | 2/1988 | Koza et al. . | |
| 4,726,608 | 2/1988 | Walton . | |
| 4,777,108 | 10/1988 | Adair . | |
| 4,835,624 | 5/1989 | Black et al. . | |
| 4,850,618 | 7/1989 | Halladay, Jr. . | |
| 4,877,253 | 10/1989 | Arens . | |
| 4,881,758 | 11/1989 | Ben-David . | |
| 4,900,617 | 2/1990 | Smith . | |
| 5,029,901 | 7/1991 | Dotson et al. . | |
| 5,058,925 | 10/1991 | Dotson . | |
| 5,074,566 | 12/1991 | Desbiens . | |
| 5,083,815 | 1/1992 | Serymgeour et al. . | |
| 5,106,089 | 4/1992 | Wood | 273/240 X |
| 5,112,058 | 5/1992 | Sandeen . | |
| 5,193,815 | 3/1993 | Pollard . | |
| 5,193,854 | 3/1993 | Borowski, Jr. et al. . | |
| 5,213,664 | 5/1993 | Hansell . | |
| 5,217,258 | 6/1993 | Sanderson . | |
| 5,228,692 | 7/1993 | Carrick et al. . | |
| 5,286,061 | 2/1994 | Behm . | |

FOREIGN PATENT DOCUMENTS

| | | | |
|---|---|---|---|
| 621061 | 10/1994 | European Pat. Off. . | |
| 2249966 | 5/1992 | United Kingdom | 273/240 |

*Primary Examiner*—William E. Stoll

*Attorney, Agent, or Firm*—Shlesinger Arkwright & Garvey

[57] ABSTRACT

A scratch-off game card includes first and second sections. The first section is provided with a first set of game data covered by a substantially opaque scratch-off material. The second section is provided with a second set of game data covered by a substantially transparent material. The second section is further provided with a substantially transparent coating for marking the second section by rubbing with an object. The markings so made are erasable by, for example, pencil eraser or the like material.

21 Claims, 3 Drawing Sheets

ERASABLE SCRATCH-OFF LOTTERY TICKET

FIELD OF THE INVENTION

This invention relates to the structure of a game card of the instant scratch-off type, and particularly but not exclusively to a Bingo game contained within the game card.

BACKGROUND OF THE INVENTION

The popularity of instant scratch-off games has grown over recent years, fostered by commercial retail interests and particularly by governmental entities as a means of raising revenue. However, sales of instant scratch-off lotteries tend to fall as the public tires of similar themes. Accordingly, lottery operators attempt to introduce new concepts while utilizing the scratch-off medium. One such concept is the adaptation of the conventional Bingo game to a scratch-off game card. In this concept, the game card is divided into a "caller" area on which random Bingo numbers are covered with opaque scratch-off material, and a "Bingo-card" area on which visible randomly printed numbers appear under the B, I, N, G, and O column headings. In this concept, the player reveals the randomly printed "called" numbers by removing the opaque scratch-off compound with a coin or similar common object and compares these with the randomly printed visible numbers shown on the "Bingo Card" areas. If the player finds that five matching numbers or "Free" space form a straight line horizontally, vertically, or diagonally, as in a conventional Bingo game, or other winning patterns as declared by the particular game rules, then that game card is recognized as a winning card entitling the player to a prize in accordance with the established prize structure of the game.

This concept requires a feature in the physical structure of the game card that is not required in prior instant scratch-off lottery game cards. This new feature is one that permits the player to mark matching numbers on the Bingo card area in a convenient way that will make a five-in-a-line or other winning condition readily evident. This feature is not only necessary to assist the player in identifying a winning pattern, but the lottery agency also requires a rapid method for identifying and confirming a winning pattern presented for redemption.

One prior art means for marking cards is described by Pollard in U.S. Pat. No. 5,193,815. In this technique the Bingo card numbers are covered with a transparent or translucent scratch-off material that contains a transparent dye or pigment of a primary color, such as yellow, which appears green when covering an underlying lightly screened tint of blue. When the yellow dyed scratch-off material is removed as a covering from a printed number, the color in that area appears to change from green to blue thus indicating a match between a "called" number and that"Bingo Card" number. While effective in indicating a matched number, this method does not allow for the possibility that a player may inadvertently scratch off a non-matched number in the Bingo card area because the method of marking is not reversible or erasable by the player.

Another prior art technique for indicating a match between "called" numbers and "Bingo-Card" numbers in described by Desbines in U.S. Pat. No. 5,074,566, in which the "Bingo Card" portion numbers are first printed over a printed screen of a color or shade different from that of scratch-off material, and then covered with an opaque scratch-off material. The scratch-off material is then printed over with an identical set of numbers. When the match is seen, the player removes the uppermost number along with the scratch-off underlying that number, revealing an identical number beneath. This method, in addition to having the shortcoming of not being erasable or reversible, entails the additional manufacturing cost of an additional digitally controlled variable printing unit of an in-line web printing system in order to print the overlying numbers, and the additional controls required to prevent the potential error of misregister between underlying and overprinted numbers in the variable printing process.

Still another prior art technique for indicating a match between the called numbers and numbers appearing in the Bingo card portion of the ticket involves the use of microencapsulated dyes, the microcapsules are in turn covered by a transparent or translucent film. The player may fracture or crush the microcapsules through the film with a coin edge and release the dye of a contrasting color from inside the capsule walls. This method also suffers from non-reversiblity as well as the added cost of microencapsulation and the special equipment needed to avoid breaking microcapsules during application to the game ticket in the manufacturing process. This technique further poses the inherent problem associated with the use of microcapsules. In particular, if the microcapsules are overprotected to prevent accidental rupture during handling, then it is difficult for the user to cause their rupture. If, on the other hand, microcapsules are insufficiently or minimally protected, then frequent unintended rupturing of microcapsules during handling of the cards occurs. This techniques is therefore undesirable as it presents many drawbacks.

OBJECTS AND SUMMARY OF THE INVENTION

It is the object of this invention to provide a printed game card with the capability for conveniently marking matches between visible numbers or other indicia with uncovered previously hidden numbers by a technique that overcomes the prior art shortcomings of non-reversibility, excessive cost, dirtiness and difficulty of markings.

It is another object of this invention to provide a formulation of a coating material that may be marked merely by rubbing with ordinary U.S. coins or objects constructed of similar metals or metal alloys.

It is another object of the invention that the marking caused by rubbing with a coin or objects constructed with metals such as those used in coins, may be removed by rubbing with a common rubber pencil eraser or other composition of erasers used to remove pencil writing.

It is another object of this invention that the coin-rub marked material is of such composition that it may be applied as a coating by conventional flexographic, gravure, serigraphic, or lithographic printing techniques.

It is another object of the invention to incorporate in the coin rub coating composition, metal oxide particles concentration in a binder, such that the metal oxide particles near the dried surface are discolored to an easily discernible level by rubbing with any common U.S. coin or object constructed of similar alloys.

It is a further object of this invention that the coin-rub coating surface be suitable for marking with common writing instruments, such as ball point pens, graphite "lead" pencils and synthetic "lead" pencils, and still retain the ability that such marking be readily erased by ordinary natural rubber or synthetic composition pencil erasers.

BRIEF DESCRIPTION OF THE DRAWINGS

FIG. I is a plan view of a game card made in accordance with the present invention showing the Bingo game with the various areas of covered and visible variable printing.

DETAILED DESCRIPTION OF THE INVENTION

Figure 1:
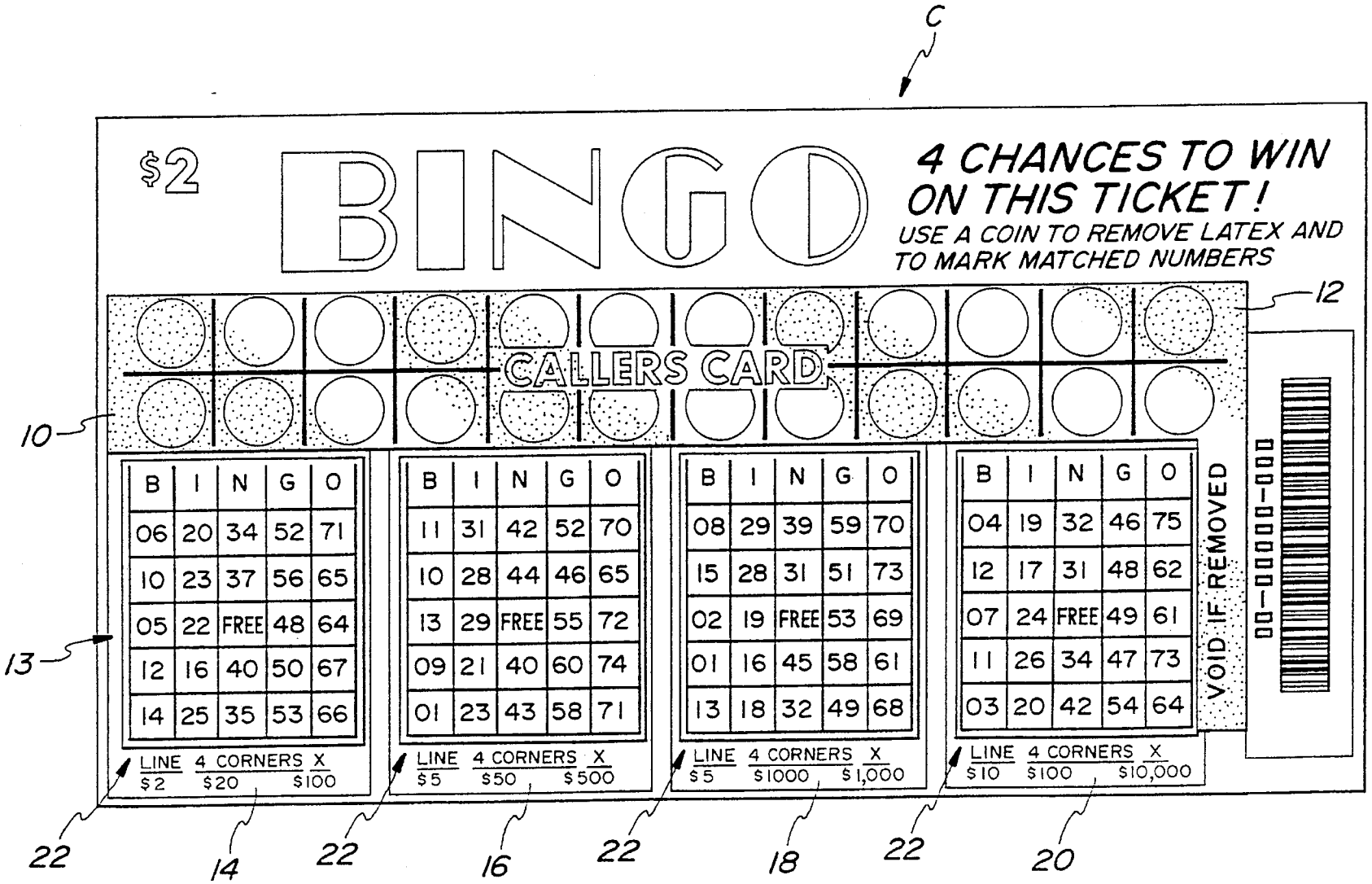

Referring to FIG. 1, a game card C in the form of a Bingo game is shown with a "callers" area 10 containing randomly drawn Bingo numbers which are concealed beneath a scratch-off latex material 12, while a series of four Bingo "cards" 14, 16, 18 and 20 are visible in the area 13, and each is provided with numbers 22 displayed in the columns below the letters B, I, N, G, and O.

Figure 2:
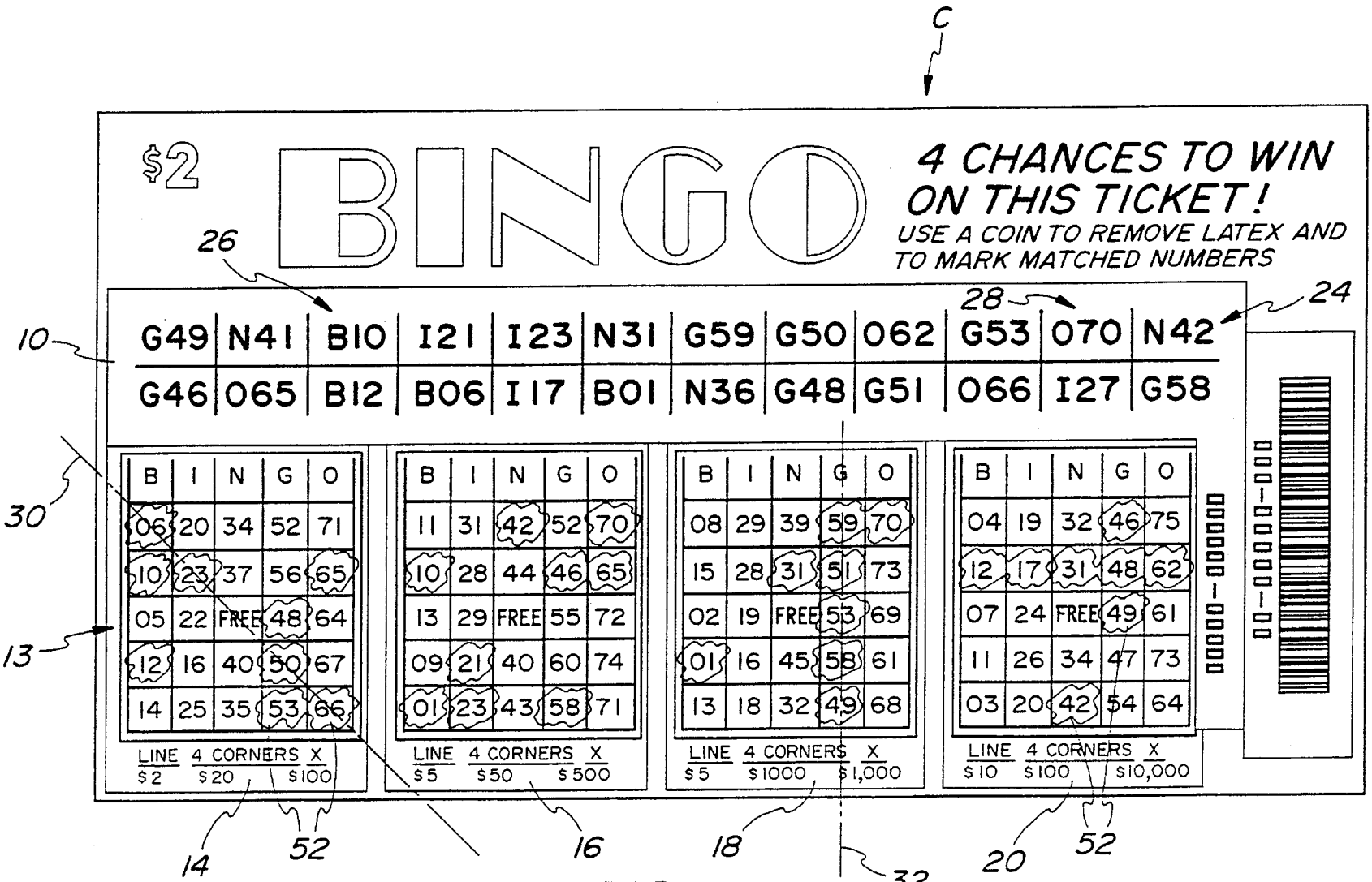
FIG. 2 is a plan view of a game card identical to that in FIG. 1, except that the scratch-off material has been removed from the "Callers Card" area and the matched Bingo numbers are marked in accordance with the technique of this invention.

Referring to FIG. 2, the latex scratch-off material 12 is shown removed revealing the "called" numbers 24. In the example shown, called number B-10, designated by numeral 26, appears in the callers area 10 and also appears on the second Bingo card area 16 in the column headed by B. The player is required to examine each Bingo card area 14, 16, 18 and 20, and compare the "called" numbers 24 with those in each Bingo card area to determine if a winning pattern, as defined by the game rules, exists. Since it is extremely difficult to remember all of the number matches and the patterns formed, provision is made for the player to mark the matched numbers by rubbing with an object, as in the case of called number 070, which appears in the called area 28, and in the second and third Bingo cards 16 and 18. In the case shown in FIG. 2, winning patterns are discerned in the first Bingo card 14 as a diagonal line 30, and on the third Bingo card 18 as a vertical line 32 in the G column.

Figure 3:
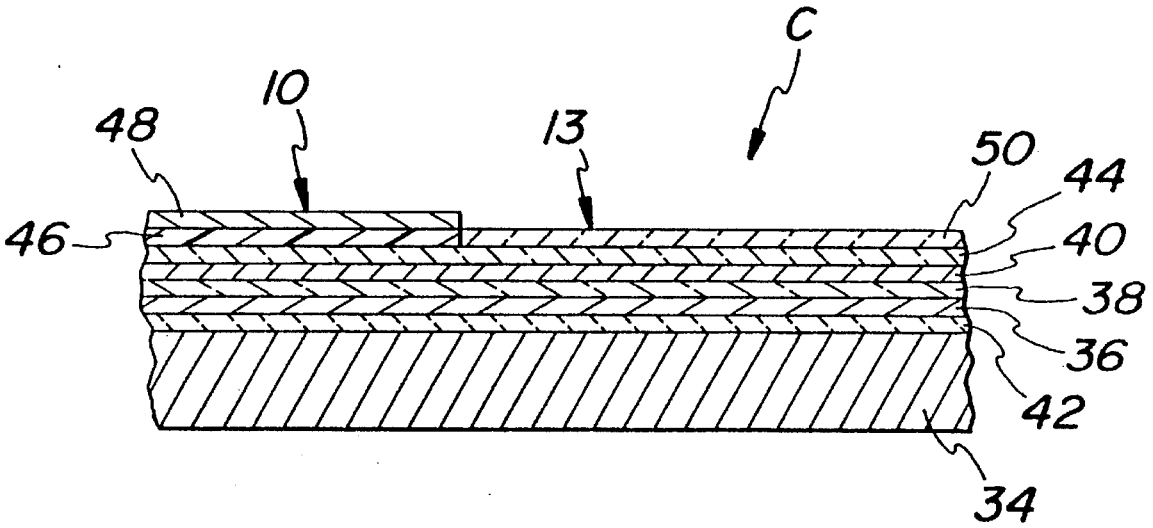
FIG. 3 is a fragmentary, schematic cross-sectional view of the preferred embodiment of the game card of the invention showing the layered structure in the Callers Card area and the Bingo card area.

Referring to FIG. 3, the layered structure of the game card C may be understood. The card C is printed and coated on a cardboard base 34 on which is first printed various graphical information 36, such as instructions, game rules and tint colored areas beneath each of the Bingo cards. Different tint colors are printed beneath each Bingo card 14, 16, 18 and 20 to provide aesthetically pleasing differentiation of the individual Bingo cards on a single game card. Next, a translucent ink jet receptive layer 38 is applied and is required for both the callers numbers 24 and the Bingo card numbers 22 because both sets are randomly drawn by computer and must be printed by variable printing means of which ink-jet 40 is most appropriate. The receptive layer 38 is preferred for ink-jet 40 over the normal clay coating 42 of cardboard stock. Next a clear coating 44, such as polyamide or acrylic is applied to protect the ink-jet printing 40 from being scratched off. A subsequent layer is of latex scratch-off coating 46 in the callers card area 10 which is removed after issuance of the game card to the player. Overprints 48 cover the scratch-off coating 46 for aesthetic purposes.

In the Bingo card area 13, FIG. 3, a coin rub coating 50 is applied to the clear coating 44. The coin rub coating 50 and the clear coating 44 are sufficiently transparent so as not to obscure clear view of the Bingo card numbers 22 underneath. The composition of the coin rub coating 50 is given in Table 1 and may be applied by flexographic, gravure, serigraphic, or lithographic printing means and dried by conventional ovens or by infra-red radiation.

TABLE 1

COIN RUB COATING FORMULATIONS IN PERCENT BY WEIGHT
Printing Method

| | FLEXOGRAPHIC | | GRAVURE | | SERIGRAPHIC | | LITHOGRAPHIC | |
|---|---|---|---|---|---|---|---|---|
| | Operable Range | Preferred Range | Operable Range | Preferred Range | Operable Range | Preferred Range | Operable Range | Preferred Range |
| Pigment Filler (e.g., metal oxide, clay, etc. | 10–70 | 35–40 | 10–75 | 35–40 | 10–90 | 35–40 | 25–40 | 30–35 |
| Polymeric Resin Vehicle (Binder) | 75–5 | 50–45 | 65–5 | 40–35 | 80–5 | 55–50 | 60–40 | 55–50 |
| Solvent | 15–5 | 15 | 25–20 | 25 | 10–5 | 10 | — | — |
| Magie Oil | — | — | — | — | — | — | 15–20 | 15 |

The polymer and solvent are those typically used in this art. For example, nitrocellulose, polyamides, and alkyds are acceptable as polymer or resin binder, and alcohols, glycoethers, and acetates are acceptable as solvents for use in the present invention. With respect to the pigment filler, a metal oxide or clay (aluminum silicate) may be used. Examples of metal oxide include titanium oxide, tin oxide, zinc oxide, aluminum oxide, etc. Likewise, examples of clay include aluminum silicates marketed by the Engelhard Corporation under the names SATINTONE®.

We have found that all United States coins mark the coin rub coating given in Table 1, as do most common metallic objects. The marking, which is grayish discoloration shown by numeral 52 in FIG. 2, obtained by rubbing with any U.S. coin, is dark enough to provide the contrast needed to readily discern a Bingo pattern.

We have also found that when the coating given in Table 1 is marked by a coin or other common object, the marking may be removed by an ordinary pencil eraser or by other commonly available synthetic compositions used as pencil erasers.

In addition we have found that any of the dried compositions shown in Table 1 may be marked by common ballpoint pens or "lead" pencils and later removed by common pencil erasers composed of natural or synthetic eraser materials.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A scratch-off game card which can be marked with an object to determine a winning pattern, comprising:

a) a first section including a first set of game data covered by a substantially opaque scratch-off material;

b) a second section including a second set of game data covered by a substantially transparent material;

c) said second section including a substantially transparent coating over said transparent material; and d) said coating can be erasably marked by a metallic object.

2. The game card of claim 1, wherein:

a) said coating comprises a formulation including a pigment filler, a polymeric binder, and a solvent.

3. The game card of claim 2, wherein:

a) said formulation comprises, by weight, about 10–90% of said pigment filler, about 5–80% of said binder, and about 0–25% of said solvent.

4. The game card of claim 3, wherein:

a) said pigment filler comprises a metal oxide.

5. The game card of claim 3 wherein:

a) said pigment filler comprises clay.

6. The game card of claim 2, wherein:

a) said formulation comprises, by weight, about 10–90% of said pigment filler, about 5–75% said binder, and about 5–15% of said solvent.

7. The game card of claim 2, wherein:

a) said formulation comprises, by weight, about 10–75% of said pigment filler, about 5–65% said binder, and about 20–25% of said solvent.

8. The game card of claim 2, wherein:

a) said formulation comprises, by weight, about 10–90% of said pigment filler, about 5–80% said binder, and about 5–10% of said solvent.

9. The game card of claim 2, wherein:

a) said formulation comprises, by weight, about 25–40% of said pigment filler, about 40–60% said binder, and about 15–20% of said solvent.

10. The game card of claim 1, wherein:

a) said coating comprises a polymeric film; and b) said film includes metal oxide particles.

11. The game card of claim 10 wherein:

a) said metal oxide comprises titanium dioxide.

12. A method of producing a scratch-off game card which can be marked with an object to determine a winning pattern, comprising the steps of:

a) providing a substrate having first and second sections;

b) providing on said first section a first set of game data;

c) providing on said second section a second set of game data;

d) covering said first set of game data by a substantially opaque scratch-off material;

e) covering said second set of game data by a substantially transparent material; and f) providing a substantially transparent coating over said transparent material, wherein said coating can be erasably marked by a metallic object.

13. The method of claim 12, wherein:

a) the step of providing a substantially transparent coating over said substantially transparent material includes using a flexographic, gravure, serigraphic, or lithographic printing technique.

14. The method of claim 12, wherein:

a) said coating comprises a formulation including a pigment filler, a polymeric binder, and a solvent.

15. The method of claim 14, wherein:

a) said formulation comprises, by weight, about 10–90% of said pigment filler, about 5–80% of said binder, and about 0–25% of said solvent.

16. The method of claim 14, wherein:

a) said formulation comprises, by weight, about 10–90% of said pigment filler, about 5–75% of said binder, and about 5–15% of said solvent.

17. The method of claim 14, wherein:

a) said formulation comprises, by weight, about 10–75% of said pigment filler, about 5–65% of said binder, and about 20–25% of said solvent.

18. The method of claim 14, wherein:

a) said formulation comprises, by weight, about 10–90% of said pigment filler, about 5–80% of said binder, and about 5–10% of said solvent.

19. The method of claim 14, wherein:

a) said formulation comprises by weight, about 25–40% of said pigment filler, about 40–60% of said binder, and about 15–20% of said solvent.

20. A scratch-off game card which can be marked with an object to determine a winning pattern, comprising:

a) a first section including a first set of game data covered by a substantially opaque scratch-off material;

b) a second section including a second set of game data covered by a substantially transparent coating;

c) means provided in said coating for erasably marking a selected area of said coating by using an object; and d) said erasably marking means comprising a metal oxide.

21. The game card of claim 20, wherein:

a) said metal oxide comprises titanium dioxide.

* * * * *